US005704215A

United States Patent [19]

Lord et al.

[11] Patent Number: 5,704,215

[45] Date of Patent: Jan. 6, 1998

[54] INTERNAL OIL SEPARATOR FOR A REFRIGERATION SYSTEM CONDENSER

[75] Inventors: Richard G. Lord, Tullahoma, Tenn.; David L. Waugh, Tully; Dennis R. Penge, Cicero, both of N.Y.

[73] Assignee: Carrier Corporation, Syracuse, N.Y.

[21] Appl. No.: 670,833

[22] Filed: Jun. 28, 1996

[51] Int. Cl.[6] ..... F25B 43/02

[52] U.S. Cl. ..... 62/84; 62/473

[58] Field of Search ..... 62/84, 85, 468, 62/470, 473

[56] References Cited

U.S. PATENT DOCUMENTS 3,201,949 8/1965 Kocher ..... 62/473

*Primary Examiner*—John M. Sollecito

[57] ABSTRACT

An oil separator for a refrigeration system having a screw compressor for pressurizing and circulating refrigerant through the system, an evaporator, a condenser and an oil separator. The oil separator is placed within the housing of the condenser.

10 Claims, 4 Drawing Sheets

INTERNAL OIL SEPARATOR FOR A REFRIGERATION SYSTEM CONDENSER

BACKGROUND OF THE INVENTION

1. Field of the Invention

This invention relates in general to refrigeration systems and, in particular, to the placement of oil separators in chiller type refrigeration systems.

2. Discussion of the Invention Background

Water cooled chiller type refrigeration systems using a screw compressor, typically include a condenser, an evaporator or cooler, an oil-refrigerant separator, an economizer and expansion devices. These components are connected to each other by tubing that carries the refrigerant through the system. The evaporator typically includes a plurality of tubes that circulate water to be cooled. The condenser typically includes a plurality of tubes through which is circulated tower water to which heat is rejected. The screw compressor requires oil for lubrication which is typically entrained in the refrigerant. The combined oil and refrigerant mixture is carried through the compression cycle and then discharged into the oil separator where the oil must be removed from the refrigerant to allow for proper operation of the heat exchangers. From the oil separator, the clean refrigerant flows to the condenser. In the past, oil separators were an external vessel and had to be designed to withstand the full operating pressure of the system.

SUMMARY OF THE INVENTION

Oil separators for chillers are generally of two types, vertical or horizontal. In a horizontal separator, the combined oil and refrigerant mix enters through an inlet. The mixture is discharged onto the end of the oil separator which causes some of the oil to separate from the refrigerant. The mixture then moves at a speed of about 1 to 4 ft/sec. through the separator. At this speed, additional oil separates from the refrigerant due to gravity. In the last phase of separation, the mixture passes through a mesh eliminator which removes all but 500 ppm of oil from the refrigerant. The refrigerant then exits from the top of the oil separator and enters the condenser. The oil drains from the bottom of the oil separator and returns to the compressor.

The inventors have discovered that the oil separator could be located inside the shell and tube condenser of the chiller. So that the oil separator can fit inside the condenser, the shell of the condenser must be increased in size and the tubes in the condenser are only placed in the bottom half of the shell. The condenser external shell is constructed to withstand the design pressure. Because the oil separator is located within the condenser, it is subjected to only a small pressure differential between the inside of the oil separator and the outside (which is inside the condenser). The pressure differential between the inside and outside of the oil separator would typically be 2–5 psi. Thus, the oil separator can be constructed from light gage metal. The present invention results in savings in both costs of manufacture and space in the assembled chiller.

BRIEF DESCRIPTION OF THE DRAWINGS

For a better understanding of the present invention, reference will be made to the following detailed description of the invention which is to be read in conjunction with the accompanying drawings, wherein.

DETAILED DESCRIPTION OF A PREFERRED EMBODIMENT

Figure 1:
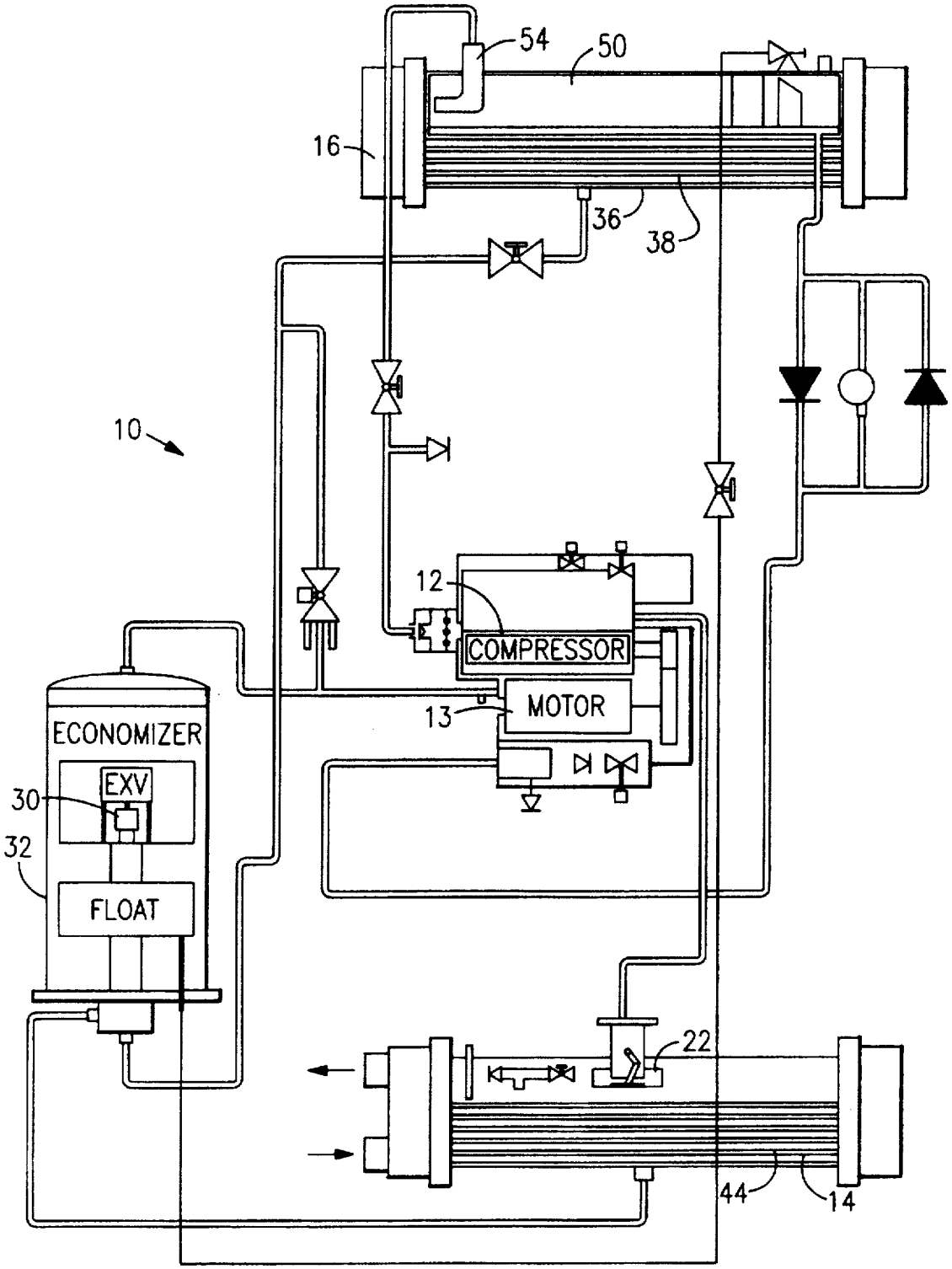
FIG. 1 is an illustration of a chiller employing the separator of the present invention.

Referring now to the drawings and initially to FIG. 1 there is shown a chiller 10 in accordance with the present invention. The chiller 10 includes a screw compressor 12, with a motor 13, an evaporator or cooler 14, a condenser 16, an expansion valve and float 30 inside an economizer 32, and an oil-refrigerant separator 50. Refrigerant flows through each of the components of the system. The liquid refrigerant exiting the condenser 16 is relatively warm. It cools down as a result of adiabatic expansion through the expansion valve and float 30 inside the economizer 32 before entering the evaporator 14. The pressure drop across the expansion valve and float 30 causes the refrigerant to drop in pressure and temperature and change from a liquid to a two-phase fluid of gas and liquid refrigerant. For the explanation, the expansion process is shown with a two-step process and an economizer vessel. Although it also can be applied to a non-economized system, the two-phase cooled refrigerant then comes in contact with the water tubes 44 in the evaporator 14 which are carrying warm water. The heat from the warm water passing through the water tubes 44 is absorbed into the liquid refrigerant which then vaporizes or evaporates the refrigerant. The refrigerant which is now in a vapor state, is induced by suction into the compressor 12 through the suction nozzle 22. In the compressor 12, the vaporized refrigerant is then increased in pressure and temperature as a result of the compression experienced therein. To lubricate the compressor bearings and components about 30 percent by weight oil is added to the beginning of the process. The compressor then discharges the refrigerant and oil mixture into the oil separator 50 where the oil and refrigerant are separated. The refrigerant then enters the condenser 16 which includes a shell or housing 36 enclosing tubes 38. The water flowing through the condenser tubes 38 absorbs heat from the compressed refrigerant which causes the refrigerant to condense.

Figure 2:
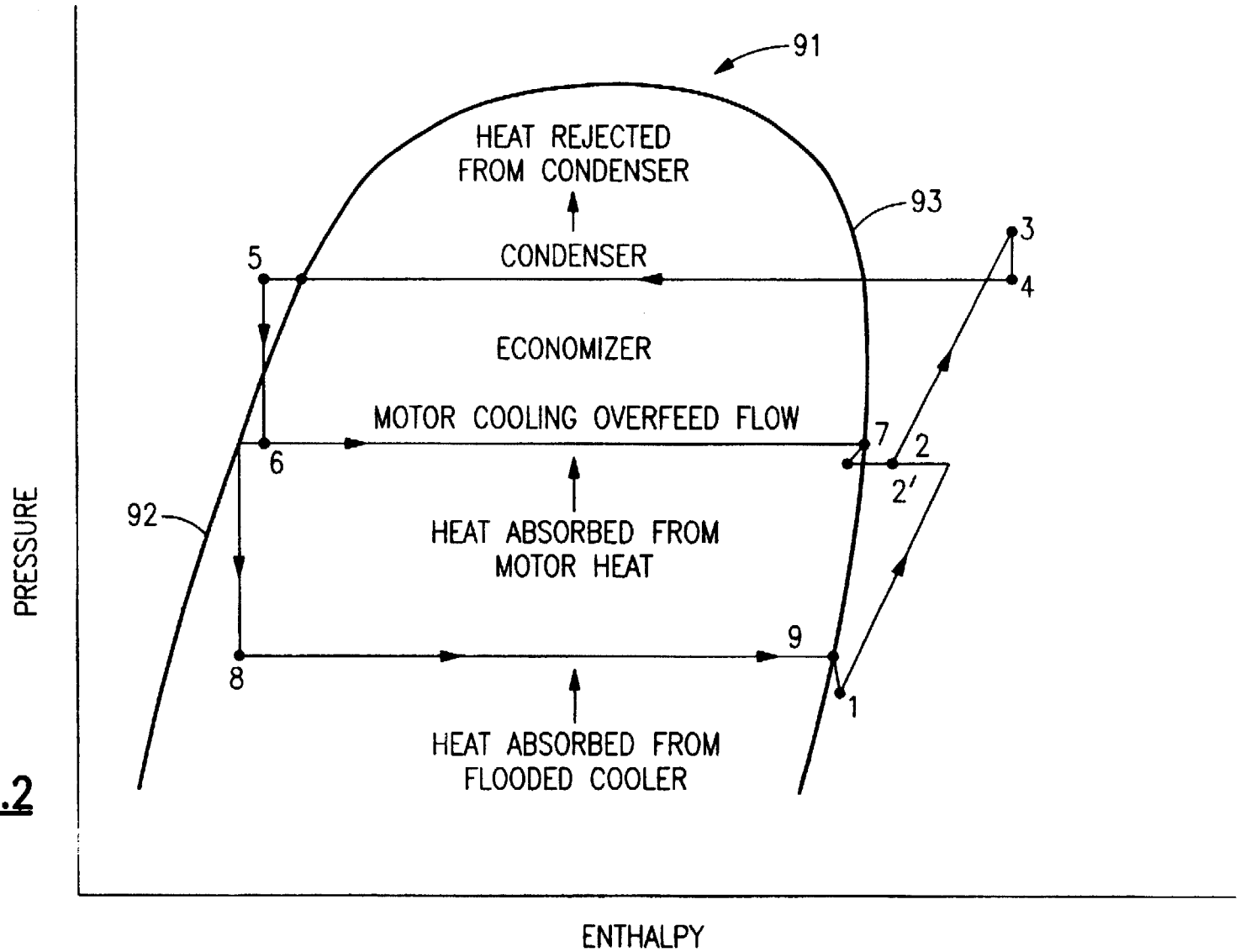
FIG. 2 is an illustration showing the phases of the refrigerant in the system.
Figure 3:
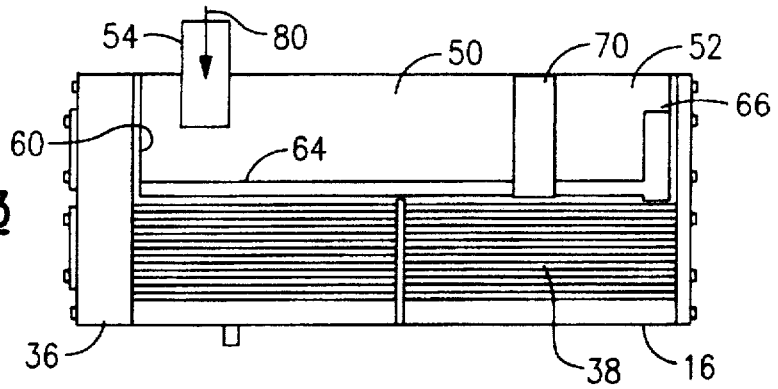
FIG. 3 is a diagrammatic illustration of the oil separator and condenser of the present invention.
Figure 4:
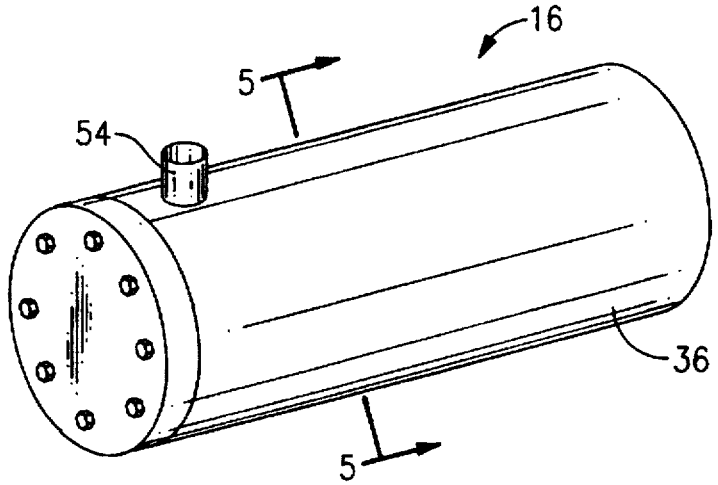
FIG. 4 is a perspective view of the condenser of the present invention.
Figure 5:
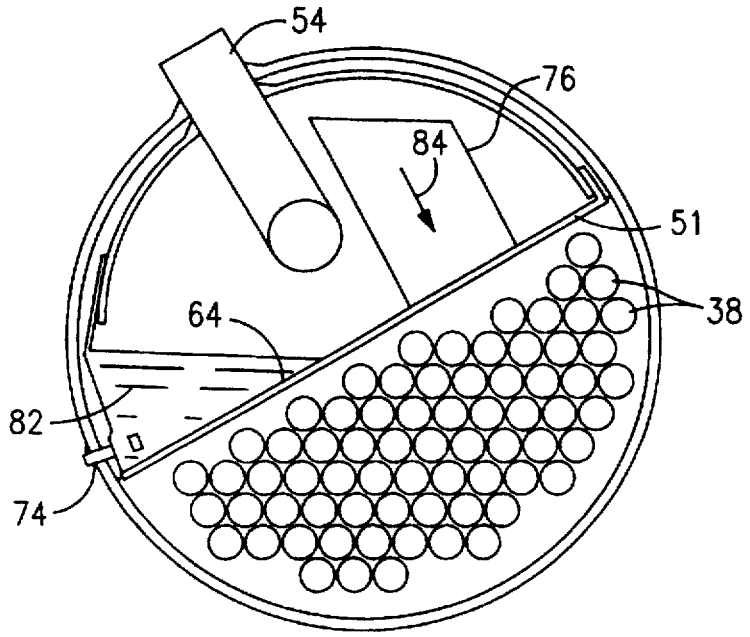
FIG. 5 is a cross-sectional view of the condenser of FIG. 4 taken along the line 4—4.
Figure 6:
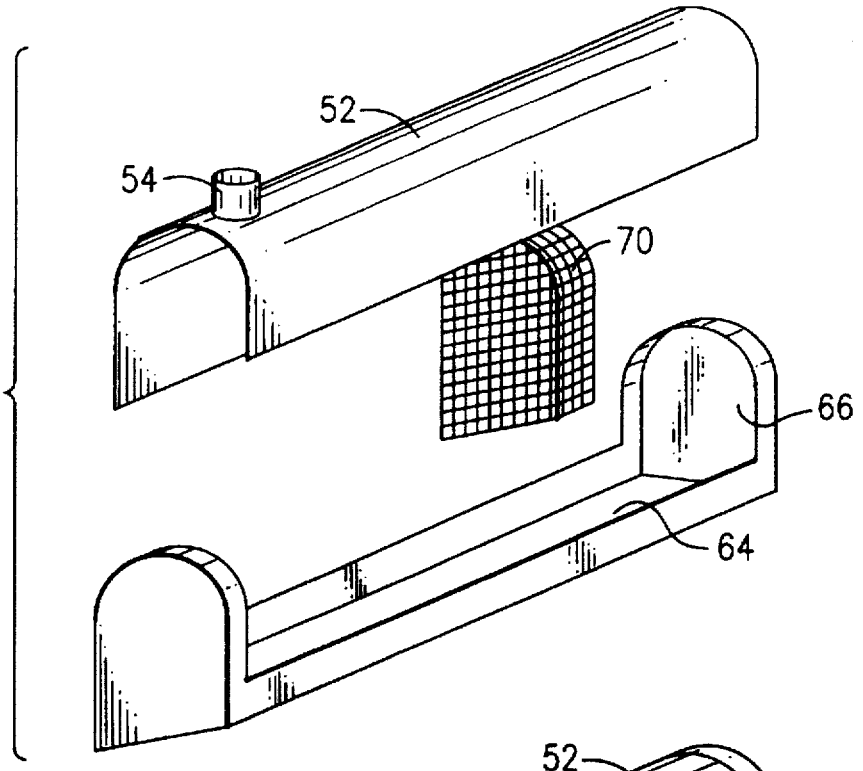
FIG. 6 is an exploded view of the oil separator of the present invention.
Figure 7:
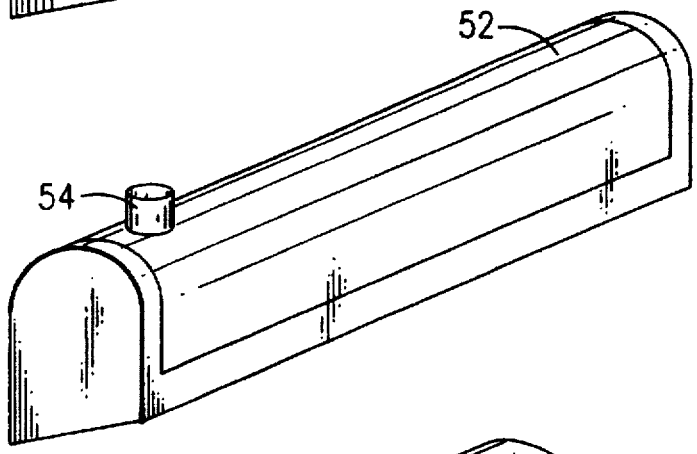
FIG. 7 is a perspective view of the oil separator of the present invention.
Figure 8:
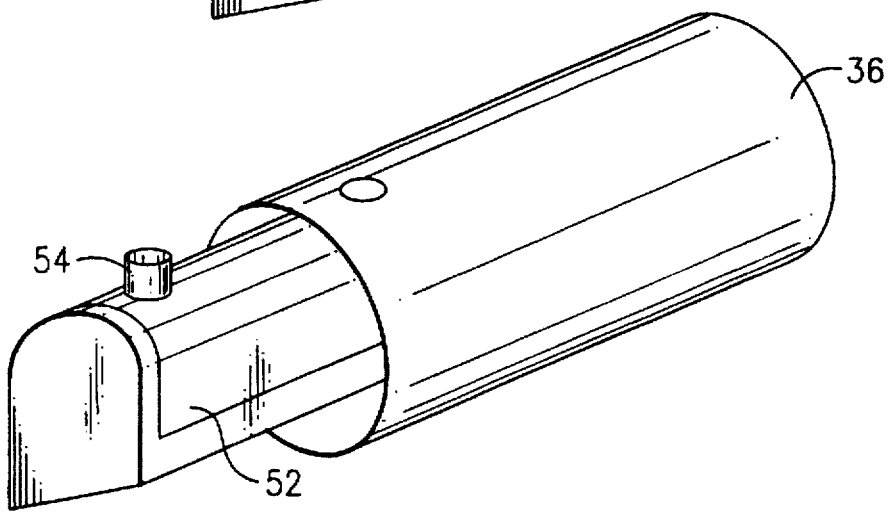
FIG. 8 is an exploded perspective view of the oil separator and condenser of the present invention.

The thermodynamic cycle of the present chiller system will be explained with reference to FIG. 2 which shows the phase changes in the refrigerant as it moves through the refrigeration loop. The refrigerant saturation curve 91 is shown wherein pressure is plotted against enthalpy. The liquid line 92 is depicted on the left hand side of the curve while the vapor line 93 is on the right hand side of the curve. Initially, slightly superheated vapor enters the suction side of the compressor 12 from the evaporator 14 at state point 1 and is compressed to a higher pressure shown at state point 2. Vapor from the economizer 32 is introduced into the compressor 12 at state point 7 where it is mixed with the in-process vapor. The compressor 12 continues to produce work on the combined vapor until the vapor reaches discharge pressure at state point 3.

The compressed vapor enters the oil separator 50 at state point 3 wherein the oil is removed from the refrigerant and returned to the compressor 12. Due to the oil separation procedure, the pressure of the refrigerant vapor drops slightly to state point 4 at the entrance to the condenser 16.

In the condenser 16, the refrigerant is reduced cooled from a superheated vapor to a liquid at state point 5 and the heat of condensation is rejected to the water passing through the tubes. Liquid refrigerant enters the economizer 32 at state point 5 and undergoes a first adiabatic expansion to state point 6 as it passes through the expansion valve 30. As a result, some of the refrigerant is vaporized and returned to the compressor 12 through the compressor motor 13 where it provides some motor cooling. The flash gas enters the compressor 12 at state point 7 where it mixes with the in process vapor at state point 2.

The remaining liquid in the economizer 32 is expanded further through float controlled throttling orifices and is delivered to the entrance of the evaporator cooler at state point 8. Here the two-phase refrigerant absorbs heat from the water being chilled and is heated to a vapor at state point 9. The refrigerant vapor at state point 9 is exposed to the suction side of the compressor 12 to complete the cycle.

In order for the screw compressor 12 to function properly, the compressor must be lubricated with oil. The oil is typically mixed with the refrigerant gas entering the rotors of the screw compressor 12. Typically about 30 percent by weight oil is mixed with refrigerant and is then carried through the compression cycle within the screw compressor 12. To allow for good performance in the condenser the oil must be reduced to less than 500 ppm, this is done by passing it through the separator 50, where the oil is removed and returned to the compressor 12. The refrigerant is then moved from the separator 50 into the condenser 16 and the refrigeration cycle is repeated. The refrigeration system schematically illustrated herein, in actual practice, may desirably comprise a selectable plurality of compressors and/or compressor stages, a selectable plurality of condensers and/or condenser stages and may or may not have an economizer. The present invention is applicable to a variety of system configurations. In FIGS. 3–8, the oil separator 50 and the condenser 16 are illustrated. The condenser 16 is shown having a cylindrical housing 36, although other housing configurations are possible. The condenser 16 has a plurality of tubes 38 in a portion of the cylindrical housing 36. The oil separator 50 has a housing 52. Preferably, the oil separator is semi-circular in cross-section with a substantially flat bottom section 51 facing the tubes 38, although many other oil separator configurations are possible. Preferably the flat bottom section is not horizontal but is disposed at an angle from the horizontal of between 20 and 60 degrees to allow for draining and collection of oil. We have found that an angle of 30 degrees works satisfactorily. The oil separator 50 is contained within the housing 36 of the condenser 16 in the portion of the condenser 16 which does not contain tubes 38. Because the oil separator 50 is inside the condenser 16, it does not have to withstand the total pressure of the refrigerant, but is only subjected to a pressure differential of about 2–5 psi. The oil separator 50 has an inlet 54 for receiving the mixture of oil and refrigerant represented by the arrow 80 from the compressor 12. The mixture flows through the inlet 54 and is discharged into the separator wall 60. The force of the impact between the mixture and the wall 60 causes some of the oil 82 to separate from the mixture. The oil flows down the wall 60 and settles on the bottom 64 of the separator 50. The mixture continues to flow through the separator 50 toward the end 66. As this occurs, gravity causes some additional oil 82 to separate out of the mixture. This oil also settles to the bottom 64 of the separator 50.

The mixture then flows through the mesh eliminator 70 which removes additional oil 82 from the mixture. The oil 82 flows out of the separator 50 through outlet 74 in the bottom 64 of the separator 50. The refrigerant, represented by the arrow 84, flows out of the outlet 76 in the bottom 64 of the separator 50. The oil 82 returns to the compressor 12 and the refrigerant 84 flows to the condenser 16.

While this invention has been described in detail with reference to a preferred embodiment, it should be appreciated that the present invention is not limited to that precise embodiment. Rather, in view of the present disclosure which describes the best mode for practicing the invention, many modifications and variations would present themselves to those of skill in the art without departing from the scope and spirit of this invention, as defined in the following claims.

What is claimed is:

1. A refrigeration system comprising:

a condenser for condensing refrigerant vapor, said condenser having a housing and tubes disposed within a condenser portion of said housing;

an evaporator for evaporating liquid refrigerant to provide cooling;

a compressor for compressing refrigerant vapor received from said evaporator, said compressor lubricated with oil such that said refrigerant vapor contains oil; and an oil separator for separating said refrigerant from said oil received from said compressor, said oil separator contained within a separator portion of said housing of said condenser said separator portion being separate from said condenser portion.

2. The refrigeration system of claim 1 wherein said tubes are disposed within a bottom portion of said housing and said oil separator is disposed in a top portion thereof.

3. The refrigeration system of claim 1 wherein said oil separator is semi-circular in cross-section with a substantially flat bottom section facing said tubes of said condenser.

4. The refrigeration system of claim 1 wherein said tubes of said condenser are disposed in a bottom portion of said condenser and wherein said oil separator is semi-circular in cross-section having a substantially flat bottom section facing said tubes of said condenser.

5. The refrigeration system of claim 4 wherein said substantially flat bottom section forms an angle of approximately 30 degrees with the horizontal.

6. A method of refrigeration comprising the steps of:

condensing refrigerant vapor in a condenser having a housing and tubes disposed within a condenser portion of said housing;

evaporating liquid refrigerant in an evaporator to provide cooling;

compressing in a compressor refrigerant vapor received from said evaporator, said compressor lubricated with oil such that said refrigerant vapor contains oil; and separating said refrigerant and oil received from said compressor, said oil separating occurring within an oil separator contained within a separator portion of said housing of said condenser said separator portion being separate from said condenser portion.

7. A refrigeration system as set forth in claim 1 wherein said separator portion includes a refrigerant outlet passing to said condenser portion.

8. A method as set forth in claim 6 and including the further step of passing the separated refrigerant from said separator portion to said condenser portion.

9. A refrigeration system as set forth in claim 1 wherein said separator portion extends the length of said housing.

10. A method of refrigeration as set forth in claim 6 wherein said separating step includes the step of passing the refrigerant along the length of the said housing.

* * * * *